United States Patent [19]

Havercroft et al.

[11] Patent Number: 4,916,905

[45] Date of Patent: Apr. 17, 1990

[54] COMBUSTORS FOR GAS TURBINE ENGINES

[75] Inventors: Peter Havercroft, Derby, England; Brian Henderson, Glasgow, Scotland

[73] Assignee: Rolls-Royce plc, London, United Kingdom

[21] Appl. No.: 284,379

[22] Filed: Dec. 14, 1988

[30] Foreign Application Priority Data

Dec. 18, 1987 [GB] United Kingdom ..... 8729497

[51] Int. Cl.[4] ..... F23R 3/06

[52] U.S. Cl. ..... 60/756; 60/757

[58] Field of Search ..... 60/756, 752, 755, 740, 60/39.32

[56] References Cited

U.S. PATENT DOCUMENTS

| | | | |
|---|---|---|---|
| 4,077,205 | 3/1978 | Pane et al. | 60/39.32 |
| 4,180,974 | 1/1980 | Stenger et al. | 60/756 |
| 4,184,326 | 1/1980 | Pane, Jr. et al. | 60/39.32 |
| 4,365,470 | 12/1982 | Matthews et al. | 60/756 |
| 4,686,823 | 8/1987 | Coburn et al. | 60/740 |
| 4,695,247 | 9/1987 | Enzaki et al. | 60/756 |
| 4,773,227 | 9/1988 | Chabis | 60/752 |
| 4,864,827 | 9/1989 | Richardson et al. | 60/756 |

FOREIGN PATENT DOCUMENTS

| | | | |
|---|---|---|---|
| 994115 | 8/1976 | Canada | 60/756 |
| 268524 | 5/1950 | Switzerland | 60/756 |

*Primary Examiner*—Louis J. Casaregola
*Assistant Examiner*—Timothy S. Thorpe
*Attorney, Agent, or Firm*—Cushman, Darby & Cushman

[57] ABSTRACT

The head assembly of a combustion chamber, within which burning of mixed fuel and air takes place, is fixed to surrounding structure in a manner which enables differential expansions of the parts of which the assembly is comprised, without generating stresses through reaction of one part upon another.

6 Claims, 1 Drawing Sheet

COMBUSTORS FOR GAS TURBINE ENGINES

BACKGROUND OF THE INVENTION

This invention relates to combustion chamber structures which are utilised for the burning of fuel/air mixtures, so as to produce a gas which in turn is ejected into a turbine which is then rotated by the ejection force which is exerted thereon.

A combustion chamber is constructed from a number of pieces of preformed sheet material. The form of a combustion chamber may be barrel like and have ends the upstream end being dome shaped and the downstream end formed so as to terminate in a portion of an annulus. Thus when a ring of combustion chambers is assembled, their downstream end extremities together make up a substantially complete annulus which matches the inlet annulus of a turbine stage.

In another arrangement, the number of barrel like combustion chambers are dispensed with and a single, annular combustion chamber is utilised. In the latter arrangement, the upstream end is defined by curves in places radially of the annulus axis, instead of curves in all planes radially of the barrel axis as in the former example, and the downstream extremity is of course, entirely annular.

Further, the curved upstream end of the annular combustion chamber will include a number of equally angularly spaced apertures therein, suitable for the receipt of fuel injection means and air swirling means. The upstream end of each barrel like combustion chamber has only one such aperture.

The unavoidable method of construction of combustion chambers is from several parts which are welded together, generates problems in use. Thus some of the parts operate in higher temperatures than other parts. Local expansion/contraction rates thus vary and cracking results. The upstream curved end is particularly susceptible to cracking and therefor, the present invention seeks to provide an improved construction for a combustion chamber of a gas turbine engine.

SUMMARY OF THE INVENTION

According to the present invention a gas turbine engine combustion chamber comprises wall structure and a head fixed to and within one end of said wall structure in spaced relationship therewith, wherein the head comprises a first member having convex and concave surfaces and an outer periphery which slidingly locates within the wall structure and a second member having convex and concave surfaces, the second member being positioned such that its convex surface is spaced from the concave surface of the first member and includes a number of projections which extend therefrom to positions closely adjacent the concave surface of the first member.

BRIEF DESCRIPTION OF THE DRAWINGS

The invention will now be described, by way of example and with reference to the accompanying drawings in which.

DETAILED DESCRIPTION OF THE INVENTION

Figure 1:
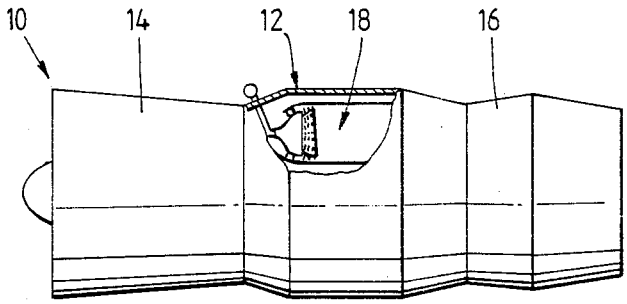
FIG. 1 is a diagrammatic view of a gas turbine engine which includes a combustion chamber in accordance with an embodiment of the present invention and FIG. 2 is an enlarged part view of the combustion chamber of Figure.

Referring to FIG. 1. A gas turbine engine 10 has combustion equipment 12 situated between a compressor 14 and a turbine 16, in known manner. In the present example, the combustion equipment is represented by a number of combustion chambers 18 equi angularly about the engine axis, again in known manner at least as regards their general arrangement. Such chambers are known as "can" type combustors to persons skilled in the field of gas turbine technology.

Figure 2:
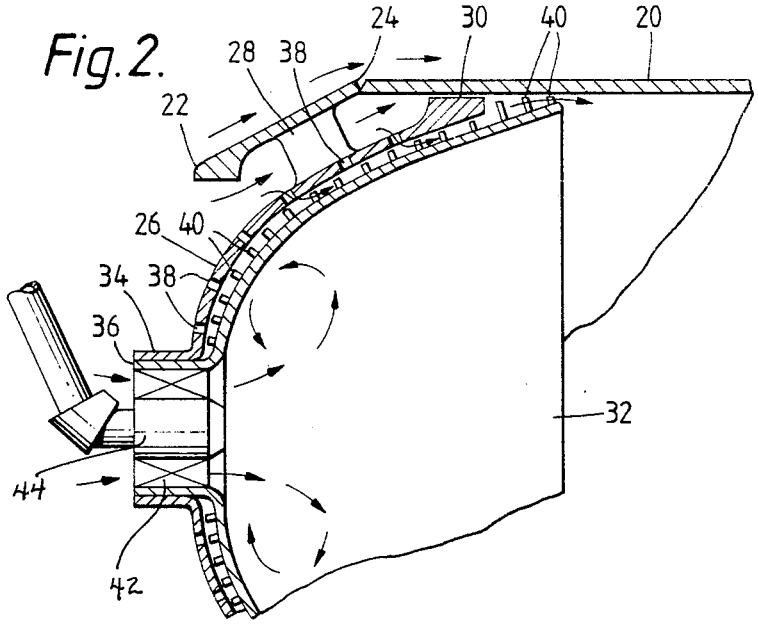

Referring now to FIG. 2. The combustion chamber 18 as stated hereinbefore, is can shaped. Thus a barrel 20 is formed from sheet metal. The barrel 20 has an upstream end 22 which is frusto conical and is welded to the barrel 20 at abutting junction 24.

A first hemispherical member 26 is fixed to the frusto conical end 22 via struts 28, which rigidly hold the member 26 in close sliding relationship with the barrel 20 via its outer periphery i.e. juncture 30.

A second hemispherical member 32 is fixed to the first member 26 via cooperating cylindrical portions 34 and 36 respectively. This fixing may be achieved by brazing, welding or any other suitable known means.

The first member 26 is formed from perforate sheet or cast metal, some of the perforations being indicated by the numeral 38. The second member 32 is also formed either from sheet or cast metal. This does not have perforations, but it does have a large number of projections 40 on its convex surface, which projections 40 extend towards the concave surface of the first member 26, to points closely adjacent that surface.

The second member 32 extends to a position which is adjacent the inner surface of the barrel 20, and the projections 40 are also continued to the outer periphery of the second member 26 and the projections thereat extend to positions close to the inner surface of the barrel 20.

During operation of the combustion chamber 18 in situ in the engine 10, cold air from the compressor 14 is supplied to the upstream end of the combustion chamber 18 and divides to flow around the outside of the barrel 20, inside the upstream end of the barrel 20, over the struts 28 and to a very small extent, through the annular gap 30, by way of leakage, but mainly through the perforations 38 and onto and around the projections 40 and thereafter into the barrel 20 via the outer peripheral extremity of the second member 32. Further, some air flows through a swirl chamber 42 and is mixed with fuel from an injector 44 the mixing, followed by burning, taking place within the confines of the second member 32. Unnumbered arrows depict the various, divided flows.

The fixing of the member 26 to the frusto conical end 22 is via the struts 28, so that is the only fixed connection therebetween. The fixing of the member 32 is via its inner end 36 to the inner end 34 of the member 26, which enables stress free expansion of the member 32. Such an arrangement greatly reduces the likelihood of cracking of the members 26 and 32.

Another advantage which is achieved by separation of the barrel 20 and members 26 and 32, is that should the barrel 20 crack for other reasons of stress, it can simply be cut off at the weld 24 and another barrel substituted, thus reducing the cost of repair by an order of magnitude which is considerable.

Whilst described in detail as being barrel shaped, the combustion chamber 12 could be of the annular kind, wherein the wall structure comprises two concentric barrels (not shown). In this arrangement, the members 26 and 32 would each be half toroids (not shown) and their inner portions 34 and 36 would each be local formations (not shown) the number of which would depend on the number of fuel injectors required.

We claim:

1. A gas turbine engine combustion chamber comprising wall structure and a head affixed to and within an end of said wall structure in spaced relationship therewith, wherein the head comprises a first perforate member having convex and concave surfaces and a second member having convex and concave surfaces and outer periphery which extends adjacent to but out of contact within the wall structure, the second member being positioned such that its convex surface is spaced from the concave surface of the first member and extends to a position downstream thereof, close to said wall structure and includes a number of projections which extend therefrom to positions closely adjacent said concave surface of the first member and the wall structure.

2. A gas turbine engine combustion chamber as claimed in claim 1 wherein the wall structure is a single cylindrical barrel shape and the first and second members are hemispherical in form.

3. A gas turbine engine combustion chamber as claimed in claim 1 wherein said wall structure comprises concentric cylinders which define an annulus and the first and second members each approximate a half toroid.

4. A gas turbine engine combustion chamber as claimed in claim 1 wherein the head is held in fixed relationship with the wall structure via rigid struts attached to the first member at a position intermediate its inner and outer peripheries.

5. A gas turbine engine combustion chamber as claimed in claim 4 wherein the first and second members are fixedly joined via local central cylindrical portions which also provide housings for air swirl chambers.

6. A gas turbine engine combustion chamber comprising wall structure and a head affixed to and within an end of said wall structure in spaced relationship therewith, wherein the head comprises a first perforate member having convex and concave surfaces and an inner end and an outer periphery and a second member having convex and concave surfaces and an inner end and an outer periphery which extends adjacent to but spaced from and within said wall structure, said combustion chamber having a fuel nozzle and said inner ends of said first and second members being fixed adjacent to said nozzle, said outer periphery of said second member extending beyond said outer periphery of said first member to a point adjacent to said wall structure, said convex surface of said second member having a plurality of projections extending therefrom toward said concave surface of said first member, said projections being distributed over said convex surface of said second member from adjacent said inner end thereof to adjacent said outer periphery whereby cooling air passing through said first perforate member will move in heat exchanging relation with said projections as well as said second member.

* * * * *